US005535594A

United States Patent [19]

Grenier

[11] Patent Number: 5,535,594

[45] Date of Patent: Jul. 16, 1996

[54] PROCESS AND APPARATUS FOR COOLING A FLUID ESPECIALLY FOR LIQUIFYING NATURAL GAS

[75] Inventor: Maurice Grenier, Paris, France

[73] Assignee: Gaz De France (Service National), Paris, France

[21] Appl. No.: 347,365

[22] PCT Filed: Apr. 5, 1994

[86] PCT No.: PCT/FR94/00380

§ 371 Date: Dec. 2, 1994

§ 102(e) Date: Dec. 2, 1994

[87] PCT Pub. No.: WO94/24500

PCT Pub. Date: Oct. 27, 1994

[30] Foreign Application Priority Data

Apr. 9, 1993 [FR] France ..... 93 04276

[51] Int. Cl.[6] ..... F25J 3/00

[52] U.S. Cl. ..... 62/612; 62/621

[58] Field of Search ..... 62/9, 11, 24, 39

[56] References Cited

U.S. PATENT DOCUMENTS

| | | | |
|---|---|---|---|
| 3,747,359 | 7/1973 | Streich | 62/24 |
| 4,274,849 | 6/1981 | Garier et al. | 62/9 |
| 4,334,902 | 6/1982 | Paradowski | 62/9 |
| 4,339,253 | 7/1982 | Caetani et al. | 62/9 |
| 4,586,942 | 5/1986 | Gauthier | 62/28 |
| 4,809,154 | 2/1989 | Newton | 62/9 |

FOREIGN PATENT DOCUMENTS

| | | |
|---|---|---|
| 0117793 | 9/1984 | European Pat. Off. . |
| 0500355 | 8/1992 | European Pat. Off. . |

*Primary Examiner*—Ronald C. Capossela
*Attorney, Agent, or Firm*—Rothwell, Figg, Ernst & Kurz

[57] ABSTRACT

In this process, which incorporates an integral cascade, the coolant mixture issuing from the penultimate stage (1B) of the compressor cycle (1) is delivered to a distillation apparatus (5) the head vapor of which is cooled (in 24) to a temperature significantly lower than the ambient temperature, then separated into two phases (in 6C); the vapor stage is supplied to the last stage (1C) of the compressor, and the liquid phase constitutes a coolant fluid for the hot part (8) of the heat exchange line (7).

44 Claims, 4 Drawing Sheets

PROCESS AND APPARATUS FOR COOLING A FLUID ESPECIALLY FOR LIQUIFYING NATURAL GAS

BACKGROUND OF THE INVENTION

The present invention relates to the cooling of fluids, and applies particularly to the liquifying of natural gas. It concerns in the first place a process for cooling a fluid, especially for liquifying natural gas, of the incorporated integral cascade type, in which a coolant mixture composed of constituents of different volatilities is compressed in at least two stages and after at least each of the intermediate compression stages the mixture is partially condensed, at least some of the condensed fractions, as well as the high pressure gas fraction being cooled, then being depressurised, put into a heat exchange relation with the fluid to be cooled, and then compressed again.

The pressures dealt with below are absolute pressures.

The liquifying of natural gas using a cooling cycle called "incorporated cascade" utilising a mixture of liquids has long been proposed.

The coolant mixture is constituted by a certain number of fluids which include, among others, nitrogen and hydrocarbons such as methane, ethylene, ethane, propane, butane, pentane, etc.

The mixture is compressed, liquified then supercooled at the high pressure of the cycle which generally lies between 20 and 50 bars. This liquifying can be put into effect in one or several stages with the condensed liquid being separated at each stage.

The liquid or liquids obtained is or are, after supercooling, depressurised to the low pressure of the cycle, generally lying between 1.5 and 6 bars, and vaporised in counter current with the natural gas to be liquified and the cycle gas to be cooled.

After reheating to about ambient temperature, the coolant mixture is once again compressed to the high pressure of the cycle.

For the operation to be possible it is necessary to have available a fluid capable of condensing at ambient temperature at the high pressure of the cycle. This poses a particular difficulty because the mixture and the pressures are generally optimized for the cold part of the liquifying installation and do not lend themselves well to a cooling which performs equally well in the hot part, that is to say lying between the ambient temperature (generally of the order of +30° C. to +40° C. in natural gas production regions) and an intermediate temperature of the order of −20° C. to −40° C.

Thus numerous existing installations require, for the hot part, a separate cooling cycle of propane or a propane-ethane mixture. Thus a relatively low consumption of specific energy is obtained, but at the price of a large increase in the complexity and cost of the installation.

SUMMARY OF THE INVENTION

The object of the invention is to eliminate the separate cooling cycle, and thus to utilise a single compressor group, that is to say a so-called "integral incorporated cascade" cooling cycle, in such a way as to permit a specific energy of the process to be obtained with, at the same time, a relatively reduced investment.

To this effect, the object of the invention is a cooling process of the type mentioned above, characterised in that the gas issuing from the penultimate compression stage is distilled in a distillation apparatus the head of which is cooled with a liquid having a temperature significantly lower than the ambient temperature, in order to form on one hand the condensate of this penultimate stage, and on the other hand a vapour phase which is delivered to the last compression stage.

In the interests of clarity, the "ambient temperature" will be defined as the thermodynamic reference temperature corresponding to the temperature of the cooling fluid (notably water) available on the site and utilised in the cycle, increased by the temperature difference, fixed by construction, at the exit of the machinery of the cooling apparatus (compressors, heat exchangers, etc.). In practice, this difference is in the region of 3° C. to 10° C., and preferably of the order of 5° to 8° C.

It will henceforth equally be noted that the cooling temperature at the head of the distillation apparatus (corresponding approximately to the temperature of the "liquid" acting to this effect) will be between about 0° C. and 20° C., and generally between 5° C. and 15° C., for an "ambient temperature" (or entry temperature into the heat exchange line) of the order of 15° C. to 45° C., and generally between 30° C. and 40° C.

Moreover, the process may comprise one or several of the following characteristics:

The cooling and partial condensing of the head vapour of the distillation apparatus by exchange of heat with at least the said depressurised fractions, and the cooling of the head of the distillation apparatus with the liquid phase thus obtained;

The cooling and partial condensing in the region of the ambient temperature of the gas issuing from the last compression stage, the depressurising of the liquid phase thus obtained and the cooling of the head of the distillation apparatus by means of this depressurised liquid phase;

Dephlegmation of the gas coming from the last compression stage during cooling;

Indirect exchange of heat between the liquid resulting from the cooling of the gas coming from the last compression stage and the head vapour of the distillation apparatus before sending this vapour to the last compression stage and depressurising the said liquid;

Pumping at least one part of the condensate from the first compression stage to the delivery pressure of the second compression stage, and mixing it with the gas coming from this second compression stage;

When the process is intended to liquify natural gas containing nitrogen, the liquified natural gas resulting from the cooling, after being de-nitrogenised, is supercooled by the exchange of heat with the liquified natural gas which has been depressurised but not denitrogenised;

When the process is intended for liquifying natural gas containing nitrogen, a preliminary de-nitrogenisation of the natural gas at its processing pressure in an auxiliary column is effected, one part of the liquified natural gas having undergone this preliminary de-nitrogenisation is depressurised to an intermediate pressure, the liquid thus depressurised by cooling the head of the auxiliary column is vaporised, which produces a combustible gas at the intermediate pressure, this combustible gas is sent to a gas turbine which drives the compressor, and the rest of the liquified natural gas having undergone preliminary de-nitrogenisation as well as the head vapour of the auxiliary column is treated in a final de-nitrogenisation column under low pressure producing the de-nitrogenised liquified natural gas to be stored in a container.

The invention also has as its object a fluid cooling installation, notably for liquifying natural gas, designed for putting this process into practice.

This installation, including a cooling circuit of integral incorporated cascade type, in which circulates a coolant mixture and which includes a compressor of at least two stages at least the intermediate stages of which are each provided with a coolant and a heat exchange line, is characterised in that it includes a distillation apparatus fed by the penultimate stage of the compressor and the head of which is connected to the suction of the last stage of the compressor, and means for cooling the head of the distillation apparatus by means of a liquid having a temperature significantly lower than the ambient temperature.

In one particular embodiment the heat exchange line is constituted by two plate exchangers of the same length in series, connected to one another by end domes and possibly welded together end-to-end.

BRIEF DESCRIPTION OF THE DRAWINGS

Exemplary embodiments of the invention will now be described with reference to the attached drawings, in which.

DETAILED DESCRIPTION OF THE DRAWINGS

Figure 1:
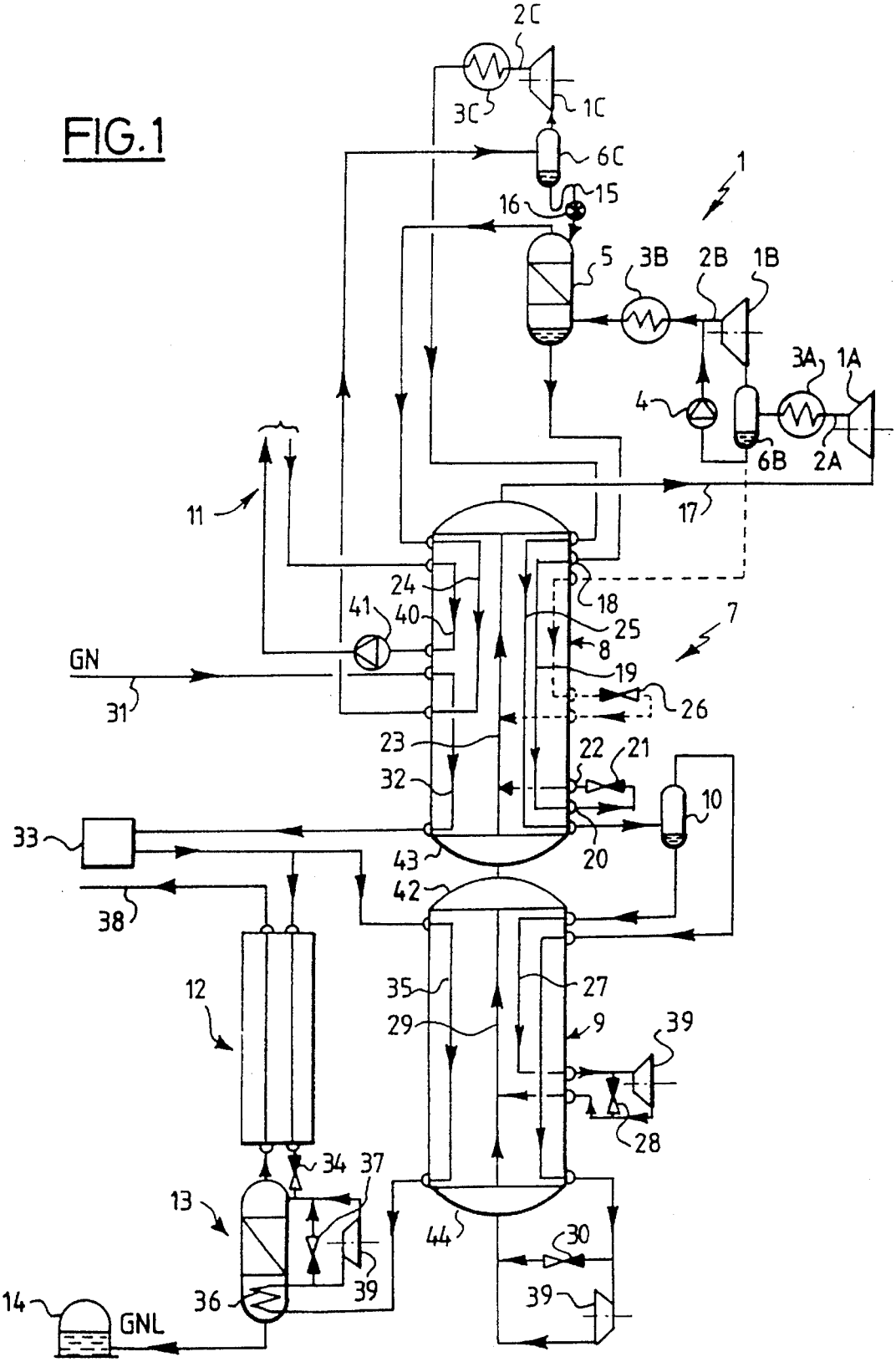
FIG. 1 schematically represents a natural gas liquifying installation in accordance with the invention.

The natural gas liquifying installation shown in FIG. 1 comprises essentially: a single compressor cycle 1 in three stages 1A, 1B and 1C, each stage leading via a respective conduit 2A, 2B and 2C, into a respective cooler 3A, 3B and 3C cooled by sea water, this water typically having a temperature of the order of +25° to +35° C.; a pump 4; a distillation column 5 having several virtual trays; separation vessels 6B, 6C the tops of which communicate respectively with the suction of the stages 1B and 1C; a heat exchange line 7 comprising two heat exchangers in series, namely a "hot" exchanger 8 and a "cold" exchanger 9; an intermediate separation vessel 10; an auxiliary cooling liquid circuit 11; an auxiliary heat exchanger 12; a de-nitrogenisation column 13; and a store of liquified natural gas (LNG) 14.

The outlet of the cooler 3A leads into the separator 6B, the bottom of which is connected to the suction of the pump 4, which leads into the conduit 2B. The outlet of the cooler 3B communicates with the container of the column 5, and the bottom of the separator 6C is connected by gravity via a syphon 15 and a regulator valve 16, to the head of the column 5.

The heat exchangers 8, 9 are rectangular exchangers with aluminium plates, possibly brazed, with a counter current flow of fluids in heat exchange relation, and have the same length. Each has the necessary ducts to ensure the operation which will be described herein, below.

The coolant mixture constituted by C1 to C5 hydrocarbons and nitrogen, exits from the top (hot end) of the heat exchanger 8 in a gaseous state and arrives via a conduit 17 at the suction of the first compressor stage 1A.

It is thus compressed to a first intermediate pressure P1, typically of the order of 8 to 12 bar, then cooled to the region of +30° to +40° C. in 3A and separated into two phases in the container 6B. The vapour phase is compressed to a second intermediate pressure P2, typically of the order of 14 to 20 bars, in 1B, whilst the liquid phase is taken by the pump 4 to the same pressure P2 and introduced into the conduit 2B. The mixture of the two phases is cooled and partially condensed in 3B, then distilled in 5.

The liquid in column 5 constitutes a first coolant liquid, adapted to ensure the main part of the cooling in the hot exchanger 8. For this purpose this liquid is introduced laterally, via an inlet 18, into the upper part of this exchanger, supercooled in ducts 19 while flowing to the cold end of the exchanger, to the region of −20° to −40° C., passed out laterally via an outlet 20, depressurised to the low pressure of the cycle, which is typically of the order of 2.5 to 3.5 bars, in a depressurisation valve 21, and reintroduced in diphasic form at the cold end of the same heat exchanger via an inlet 22 and an appropriate distribution device, to be vaporised in the low pressure ducts 23 of the heat exchanger.

The head vapour of the column 5 is cooled and partially condensed in ducts 24 of the heat exchanger 8 to an intermediate temperature markedly lower than the ambient temperature, for example to +5° to +10° C., then introduced into the container 6C. The liquid phase flows as a return flow back by gravity, via the syphon 15 and the valve 16, to the head of the column 5, whilst the vapour phase is compressed to the high pressure of the cycle, typically of the order of 40 bars, in 1C, then is returned in the region of +30° to +40° C. in 3C. This vapour phase is then cooled from the hot end to the cold end of the heat exchanger 8 in high pressure ducts 25, and separated into two phases in 10.

To complete the cooling of the exchanger 8 it is possible as represented by a broken line, to supercool to an intermediate temperature part of the liquid collected in 6B, then withdraw it laterally from the exchanger, depressurise it to the low pressure in a depressurisation valve 26, and reintroduce it laterally into the exchanger to vaporise it in the intermediate part of the low pressure ducts 23.

The cooling of the heat exchanger 9 is obtained by means of fluid at high pressure, in the following manner.

The liquid collected in 10 is supercooled in the hot part of the exchanger 9, in ducts 27, then withdrawn from the exchanger, depressurised to low pressure at a depressurisation valve 28, reintroduced into the exchanger and vaporised in the hot part of the low pressure ducts 29 of the latter. The vapour phase issuing from the separator 10 is cooled, condensed and supercooled from the hot end to the cold end of the exchanger 9, and the liquid thus obtained is depressurised to the low pressure in a depressurisation valve 30, and reintroduced at the cold end of the exchanger to be vaporised in the cold part of the low pressure ducts 29, then reunited with the depressurised fluid in 28.

The treated natural gas, in the region of +20° C. after drying, via a conduit 31, is introduced laterally into the heat exchanger 8 and cooled in passing to the cold end of the latter in ducts 32.

At this temperature, the natural gas is delivered to apparatus 33 for the elimination of C2 to C5 hydrocarbons, and the mixture that remains, constituted essentially of methane and nitrogen, with a small quantity of ethane and propane, is divided into two streams: a first stream, cooled, liquified and supercooled from the hot end to the cold end of the auxiliary exchanger 12, then depressurised to the region of 1.2 bar at a depressurisation valve 34, and a second stream, cooled, liquified and supercooled from the hot end to the cold end of the exchanger 9 in ducts 35, supercooled once again from about 8° to 10° C. in a coil 36 forming a distillation vessel of the column 13, and depressurised to the region of 1.2 bar in a depressurisation valve 37. The two depressurised streams are reunited then introduced as a return flow at the head of the column 13, which thus assures the de-nitrogenisation of the natural gas. The liquid in this column constitutes the de-nitrogenised LNG produced by the installation and is delivered to the storage container 14, whilst the head vapour is reheated from −20° to −40° C. in passing from the cold end to the hot end of the exchanger 12 and is delivered via a conduit 38 to the "fuel gas" reservoir to be burned or utilised in a gas turbine of the installation serving to drive the compressor 1.

It is to be noted that a supplementary cut can be made to the natural gas in the exchanger 9 at a temperature permitting the recovery of additional quantities of C2 and C3 hydrocarbons in the apparatus 33.

As has been shown, taking into account the very considerable output usually achieved in such an installation, it could be desirable to depressurise part of the cold liquids in liquid turbines or "expanders" 39 for cooling as well as producing part of the electrical current necessary. In addition the hottest part of the exchanger 8 can be used to cool an appropriate liquid notably pentane from approximately +40° to +20° C. circulated in ducts 40 of the exchanger by a pump 41 and serving to cool another part of the installation, for example the raw natural gas destined to be dried before processing in the liquifying installation. This circulation of liquid constitutes the cooling circuit 11 cited above.

The equipment described above permits at the same time acceleration of the condensation of the mixture issuing from the second compression stage 1B, thanks to the injection of liquid into the conduit 2B by means of the pump 4, and simplification of the exchanger 8 if the entirety of the liquid in the container 6B is pumped, and also allows a high pressure mixture sufficiently free of heavy components to be obtained. More precisely, in the example considered, almost all of the C5 hydrocarbons and the majority of the C4 hydrocarbons may be totally vaporised at the hot end of the ducts 29 of the cold exchanger 9. This presents the important advantage that the ducts can lead into an upper dome 42 of the exchanger 9 communicating directly with a lower dome 43 of the exchanger 8, without any diphasic redistribution being necessary at the cut between the two exchangers; the installation can be further simplified by welding the two exchangers 8 and 9 end to end.

It can also be noted that the suction of the compressor stage 1C at a relatively cool temperature is favourable to the performance of the latter. The cut in the region of −20° to −40° C. approximately between the two exchangers corresponds moreover to heat exchange surfaces of the same order above and below this division, so that two exchangers 8 and 9 of maximum length can be used in optimal thermal conditions and a single separator container 10, at the division cited above, for the high pressure liquid.

It is understood that the control of the temperature and of the pressure +5° to +10° C. (14 to 20 bars) of the cooling liquid of the head of column 5 permits a monophasic gas to be obtained at the same time at the exit of the cooler 3C and exit (42) of the cold exchanger 9 (at −20° C. to −40° C. approximately, 2.5 to 3.5 bars).

It is to be noted that in practice N exchangers 8 are mounted in parallel and N exchangers 9 in parallel.

Figure 2:
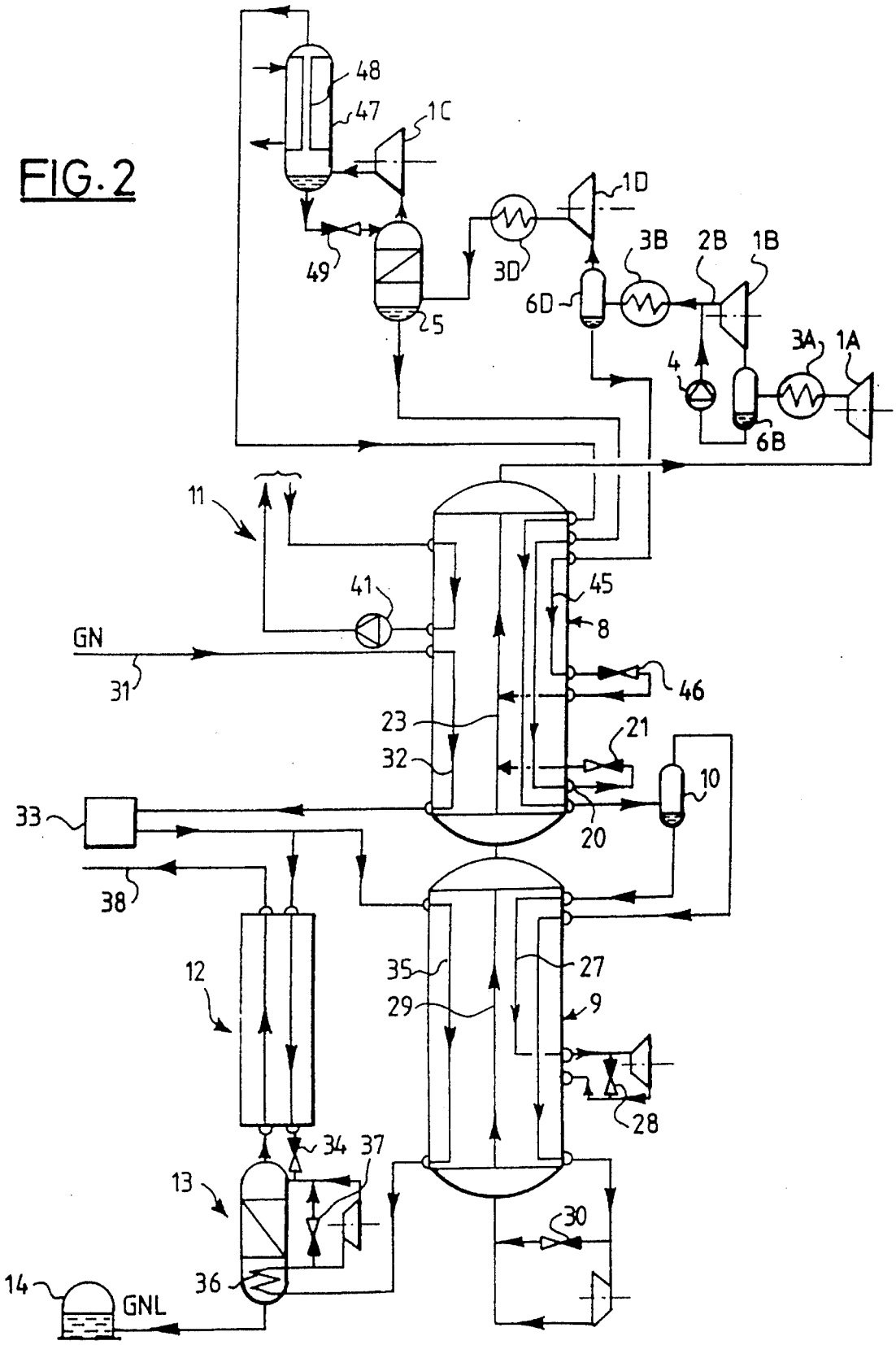
FIG. 2 schematically represents another embodiment of the installation according to the invention.

The installation represented in FIG. 2 only differs from that in FIG. 1 by the addition between the compression stages 1B and 1C, of another intermediate compression stage 1D as well as by the manner in which the return flow liquid in column 5 is cooled.

Thus the cooler 3B leads into a separation container 6D, the vapour phase of which feeds the stage 1D. The output of the latter is cooled by a cooler 3D then introduced to the base of the column 5. The liquid in the container 6D constitutes an additional cooling liquid supercooled in additional ducts 45 provided in the hot part of the exchanger 8, exiting from the latter depressurised to the low pressure at a depressurisation valve 46 and reintroduced into the exchanger to be vaporised in the intermediate part of the low pressure ducts 23.

Moreover the head vapour of the column 5 is sent directly to the suction of the last compression stage 1C, and the fluid at high pressure is sent to the base of dephlegmator 47 cooled by a trickle of seawater over vertical tubes 48. The majority of the heavy elements are collected at the base of the dephlegmator, depressurised in a depressurisation valve 49 and introduced as a return flow at the head of column 5, and the head vapour of the dephlegmator forms, as before, the high pressure coolant, which is cooled in passing to the cold end of the exchanger 8 then after separation of the phases in 10, as it passes to the cold end of the exchanger 9.

Figure 3:
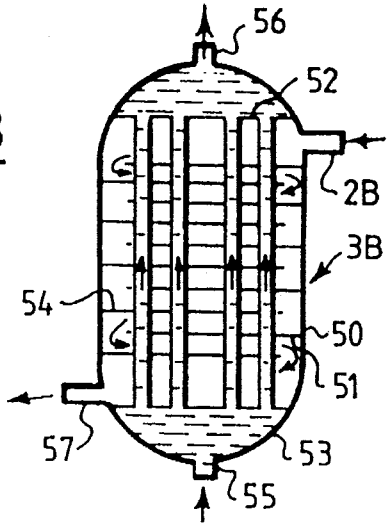
FIG. 3 represents in more detail an element of the installation of FIG. 2.

FIG. 3 represents an embodiment of a heat exchanger capable of being used as an intermediate cooler 3B. This exchanger comprises a grid 50 in which a certain number of vertical tubes 51 open at their two ends extend between an upper plate 52 and a lower plate 53. Between these two plates and on the exterior of the tubes are mounted a certain number of horizontal chicanes 54.

Cooling water arrives, through a lower opening 55 at the plate 53, flows upwards through tubes 51 and is evacuated through an upper channel 56. The dipbasic mixture delivered by the conduit 2B enters laterally into the grid under the plate 52 and descends along the chicanes, then exits by the exit conduit 57 of the exchanger, situated a little above the plate 53.

Such equipment allows proper homogenisation of the diphasic mixture during its cooling, and an improvement in the acceleration of the condensation in the second stage of the compressor 1 brought about by the loop comprising the pump 4.

Figure 4:
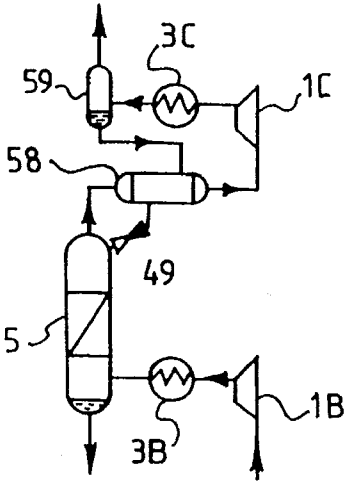
FIG. 4 schematically represents one part of a variation of the installation of FIG. 1.

FIG. 4 represents a further variation of the layout of the distillation column 5. In this variation, the head vapour of the column is reheated by several degrees celsius in an auxiliary heat exchanger 58, then sent to the suction of the last compression stage 1C. The high pressure fluid, after cooling and partial condensation in 3C to the region of +30° to +40° C. is separated into two phases in a separator vessel 59. The vapour issuing from this vessel constitutes the high pressure coolant fluid, whilst the liquid phase, after supercooling by several degrees celsius in the exchanger 58, is depressurised in a depressurisation valve 49 as in FIG. 2 then introduced as a return flow to the head of column 5.

It is to be understood that this variation can be applied to an installation of either three or four compression stages. In addition, the supercooler 58 is optional.

Figure 5:
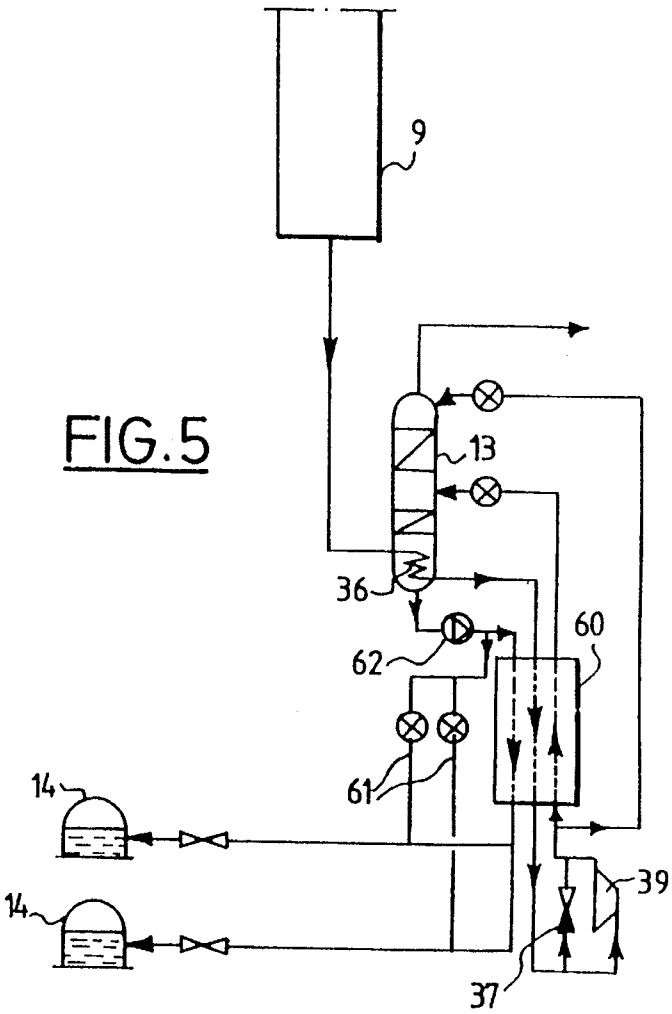
FIG. 5 schematically represents a variant of the cold part of the installation of FIGS. 1 or 2.

Whatever the embodiment under consideration, the de-nitrogenisation column 13 should function in the region of 1.15 bars to 1.2 bars, and consequently the de-nitrogenised LNG exiting from the vessel of this column should be depressurised to atmospheric pressure at the inlet of the store 14, which produces flash gas. This gas as well as gas resulting from heat leaking into the store 14, must then be reclaimed and compressed by an auxiliary compressor in order to be delivered to the "fuel gas" reservoir. FIG. 5 shows an arrangement which permits omission of the auxiliary compressor, in the case where the LNG exiting from the exchanger 9 contains several percent nitrogen.

For this, the LNG exiting from the exchanger 9 supercooled in the coil 36 of the column 13 and is once again supercooled in an auxiliary heat exchanger 60. The liquid is then depressurised to 1.2 bars in the depressurisation valve 37 and the turbine 39, then divided into two streams: one stream is vaporised in the exchanger 60 and then introduced at an intermediate level into the column 13, and one stream is sent as a return flow to the head of this latter.

The liquid of the column 13, which is LNG without nitrogen, is then for each store, divided into two streams one of which is supercooled in the exchanger 60 whilst the other passes into a branch 61 to regulate the overall degree of supercooling, circulation of the liquid being assured by a pump 62.

In this way, it is liquid supercooled to about 2° C. which is delivered to the stores 14, which practically suppresses all flash at the entry of these stores and all evaporation due to the entry of heat with the passage of time. As is understood it is the difference of composition of the LNG before and after de-nitrogenisation which allows such supercooling in the exchanger 60 to be obtained.

In the same way, the head vapour in the column 5 is generally sufficiently rich in methane to be recovered as such for "fuel gas", in the way indicated above. It is thus necessary to provide another auxiliary compressor for this purpose. If, moreover, the compressor cycle 1 is driven by a gas turbine, it is necessary to feed the latter by combustible gas under a pressure of the order of 20 to 25 bars, which leads to the installation of an auxiliary compressor of some power. The arrangement in FIG. 6 shows how the need for such an auxiliary compressor can be avoided.

Figure 6:
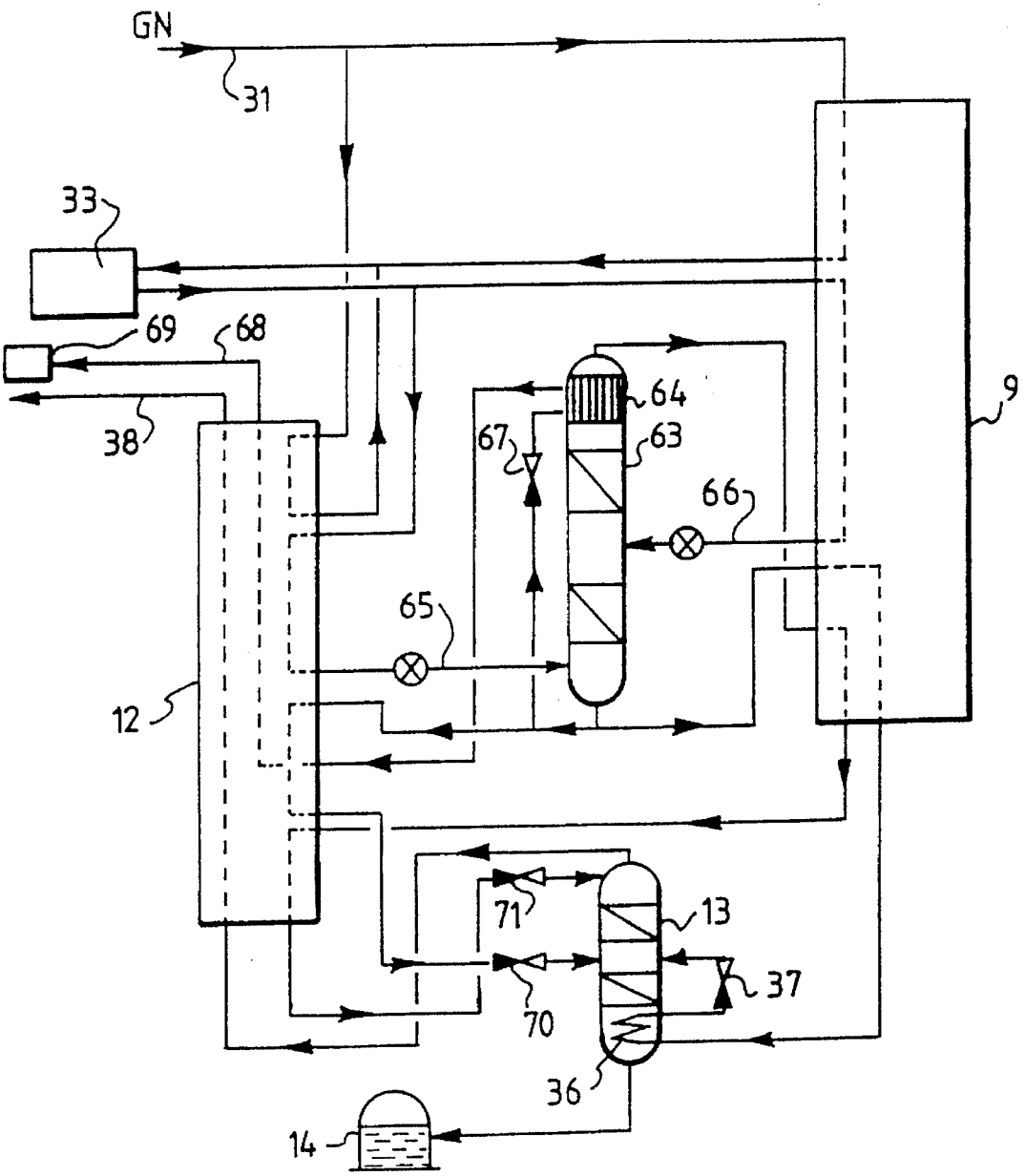
FIG. 6 is a schematic partial view of another variant of the installation according to the invention.

In FIG. 6, a further preliminary de-nitrogenisation column 63 is used under the pressure of natural gas, provided with a head condenser 64.

That part of the natural gas coming from the apparatus 33 which is treated in the exchanger 12 is only cooled there to an intermediate temperature T1, then is introduced into the column 63, via a conduit 65, while the rest of this natural gas is only cooled in the exchanger 9 to an intermediate temperature T2 lower than T1 then introduced at an intermediate level of the same column, via a conduit 66.

The cooling of the condenser 64 is assured by releasing the pressure of a part of the liquid in the column to the region of 25 bars in a depressurisation valve 67. The gas resulting from this vaporisation has the same composition as the liquid in the column, that is to say possesses low grade nitrogen, and thus constitutes a combustible gas below 25 bars which is directly usable, via a conduit 68, in the gas turbine 69.

The rest of the liquid in the column 63 is, after supercooling partly in the cold part of the exchanger 9 and the coil 36 of the column 13, and partly in the cold part of the exchanger 12, depressurised in 37 and 70 respectively and introduced at an intermediate level into the column 13. The head vapour in the column 63, containing 30–35% nitrogen is cooled and condensed in the cold part of the exchanger 9, supercooled in the cold part of the exchanger 12 and after depressurisation at a depressurisation valve 71, introduced as a return flow to the top of column 13.

The nitrogen enrichment of the wash liquid of the column 13 has as a consequence that the nitrogen vapour of this column is sufficiently weak in methane, for example containing 10–15% of methane to be put into the atmosphere via the conduit 38 after reheating in 12.

Thus two residual gases are obtained in total, one of which is rich in methane and under 25 bars and feeds the gas turbine and the other of which at low pressure is weak in methane and is not recovered.

As represented in FIG. 6 a fraction of the natural gas to be treated carried by the conduit 31 can be cooled in the hot part of the exchanger 12 before being sent to the apparatus 33.

I claim:

1. A fluid cooling process for cooling a fluid, the process comprising steps of:

compressing a cooling mixture comprising constituents of various volatilities in a penultimate stage among a plurality of compression stages;

partially condensing said cooling mixture to obtain a liquid fraction and a vapour fraction, said fractions having a determined temperature;

distilling at least the vapour fraction from said penultimate compression stage in a distillation apparatus comprising a head upper part and a lower part, while cooling said head upper part of the distillation apparatus with a cooling fluid having a temperature lower than said determined temperature of at least said vapour fraction, and obtaining a cooled distillator head vapour phase and a cooled distillator liquid phase;

sending said cooled distillator head vapour phase toward a final high compression stage of said plurality of compression stages, and obtaining a high pressure vapour phase; and cooling, depressurizing and putting into a heat exchange relation with said fluid to be cooled at least some of said liquid fraction, said distillator liquid phase and said high pressure vapour phase.

2. A process according to claim 1, wherein said plurality of compression stages include at least two compression stages including said final high compression stage and at least one intermediate compression stage prior to said high compression stage, said cooling mixture being condensed at each intermediate compression stage.

3. A process according to claim 1, wherein the step of depressurizing at least some of said liquid fraction, said distillator liquid phase and said high pressure vapour phase comprises depressurizing at least some of said liquid fraction, said distillator liquid phase and said high pressure vapour phase to a substantially common pressure.

4. A process according to claim 1, further comprising partially condensing said high pressure vapour phase before cooling, depressurizing and putting said high pressure vapour into said heat exchange with the fluid to be cooled.

5. A process according to claim 1, wherein said fluid for cooling the upper part of the distillation apparatus is a liquid having a temperature lower than a temperature in the range of from about 15° C. to 45° C.

6. A process according to claim 5, wherein the step of cooling said head upper part of said distillation apparatus comprises:

partially condensing the high pressure vapour phase for obtaining a high pressurized liquid phase; and depressurizing and sending said high pressure liquid phase to said head upper part of the distillation apparatus as said cooling liquid.

7. A process according to claim 5, wherein said plurality of compression stages comprise at least a first, a second and a third compression stage, and further comprising steps of:

compressing said cooling mixture in at least the first compression stage;

partially condensing said compressed cooling mixture, for obtaining a first compression stage condensate and a first compression stage vapour phase;

pumping at least a part of said first compression stage condensate to an exit pressure of the second compression stage; and mixing said pressurized first compression stage condensate with the resultant issuing from said second compression stage.

8. A process according to claim 1, wherein the steps of distilling at least the vapour fractions of said penultimate stage of compression, while cooling the head upper part of the distillation apparatus and sending the distillator head vapour phase towards the final high compression stage comprise:

distilling at least said vapour fractions of said penultimate compression stage in said distillation apparatus, for obtaining a first vapour phase and a first liquid phase;

partially condensing said first vapour phase for obtaining a second vapour phase and a second liquid phase;

cooling said head upper part of the distillation apparatus with said second liquid phase; and sending said second vapour phase to the final high compression stage, the second vapour phase constituting said cooled distillator head vapour phase.

9. A process according to claim 1, wherein both the steps of distilling at least the vapour fractions of said penultimate compression stage, while cooling said head upper part of the distillation apparatus and sending said distillator head vapour phase towards the final high compression stage comprise:

compressing said distillator head vapour phase in said final high compression stage;

cooling and partially condensing said resulting high pressure vapour phase, for obtaining a second vapour phase and second liquid phase;

depressurizing said second liquid phase so that said depressurized second liquid phase has a temperature lower than the temperature of the head upper part of said distillation apparatus, and sending said depressurized second liquid phase to said head upper part of the distillation apparatus, and using said depressurized second liquid phase as said cooling fluid.

10. A process according to claim 9, wherein the step of depressurizing said second liquid phase comprises depressurizing said second liquid phase to a temperature lower than a temperature range of from about 15° C. to 45° C.

11. A process according to claim 1, wherein both the steps of distilling at least the vapour fractions of said penultimate compression stage, while cooling said head upper part of the distillation apparatus and sending said cooled distillator head vapour phase toward the final high compression stage comprise:

condensing and separating said high pressure vapour phase, for obtaining a second vapour phase and a second liquid phase;

realizing a heat exchange between said second liquid phase and the head vapour phase issued from said distilling apparatus, for heating said distillator head vapour phase before providing therewith said high compression stage, while cooling said second liquid phase; and depressurizing said cooled second liquid phase before sending said depressurized second liquid phase to said head upper part of the distillation apparatus, the depressurized second liquid constituting said cooling fluid.

12. A process according to claim 1, further comprising partially condensing said distillator head vapour phase before compressing the distillator head vapour phase in said final compression stage.

13. A process according to claim 1, wherein said temperature of the fluid for cooling the head upper part of the distillation apparatus is in a range of from about 0° C. to 20° C.

14. A fluid cooling process for cooling a fluid, the process comprising steps of:

compressing a cooling mixture comprising constituents of various volatilities in a penultimate stage among a plurality of stages of compression;

partially condensing said mixture for obtaining a liquid fraction and a vapour fraction;

distilling at least the vapour fraction of said penultimate compression stage in a distillation apparatus comprising an upper part and a lower part, for obtaining a first vapour phase and a first liquid phase;

cooling said first vapour phase for partially condensing said first vapour phase, so as to obtain a second vapour phase and a second liquid phase;

cooling said upper part of the distillation apparatus with said second liquid phase;

compressing said second vapour phase in the final compression stage of said plurality of compression stages for obtaining a high pressure vapour phase; and cooling, depressurizing and putting into a heat exchange relation with said fluid to be cooled, at least some of said liquid fraction, said first liquid phase and said high pressure vapour phase;

wherein said cooling to partially condense said first vapour phase comprises a heat exchange thereof with at least some of said liquid fraction, first liquid phase and high pressure vapour phase.

15. A process according to claim 14, further comprising partially condensing said high pressure vapour phase before cooling, depressurizing and putting said high pressure vapour phase into said heat exchange with the fluid to be cooled.

16. A fluid cooling process comprising:

compressing a cooling mixture comprising constituents of various volatilities in the penultimate stage among a plurality of compression stages;

partially condensing said mixture for obtaining liquid and vapour fractions;

distilling at least said vapour fraction of the penultimate compression stage in a distillation apparatus comprising a head upper part and a lower part, while cooling said head upper part of the distillation apparatus with a cooling liquid, so as to obtain a first head vapour phase and a first liquid phase;

sending said first head vapour phase to the final compression stage of said plurality of compression stages for obtaining a high pressure gas;

cooling and partially condensing said high pressure gas, for obtaining a second vapour phase and a second liquid phase;

depressurizing said second liquid phase having a temperature lower than the temperature of the head upper part of said distillation apparatus, and sending said depressurized second liquid phase to said upper part of the distillation apparatus, so as to use said depressurized second liquid phase as said cooling liquid; and cooling, depressurizing and putting into a heat exchange relation with said fluid to be cooled, at least some of said liquid fraction, said first liquid phase and said high pressure gas.

17. A process according to claim 16, wherein the step of depressurizing said second liquid phase comprises depressurizing said second liquid phase to a temperature lower than a temperature range of from about 15° C. to 45° C.

18. A process according to claim 16, wherein the step of cooling and partially condensing said high pressure gas comprises circulating said high pressure gas in a deflegmator.

19. A fluid cooling process for cooling a fluid, the process comprising steps of:

compressing a cooling mixture comprising constituents of various volatilities in the penultimate stage among a plurality of compression stages;

partially condensing said mixture for obtaining a liquid fraction and a vapour fraction;

distilling at least said vapour fraction of said penultimate compression stage in a distillation apparatus comprising a head upper part and a lower part, while cooling said head upper part of the distillation apparatus with a cooling liquid, so as to obtain a first head vapour phase and a first liquid phase;

sending said first head vapour phase toward the final compression stage of said plurality of compression stages, for obtaining a high pressure gas;

cooling and partially condensing said high pressure gas, for obtaining a second vapour phase and second liquid phase;

wherein said steps of both distilling at least said vapour fraction in a distillation apparatus while cooling the head upper part of said distillation apparatus, and sending said first head vapour phase toward the final compression stage, comprise conducting a heat exchange between said second liquid phase and said first head vapour phase, for cooling the second liquid phase while heating the first head vapour phase before compressing the first head vapour phase in said final compression stage;

depressurizing said cooled second liquid phase so as to have a temperature lower than the temperature of the head upper part of said distillation apparatus; and sending said depressurized second liquid phase to said head upper part of the distillation apparatus, so as to use said depressurized second liquid phase as said cooling liquid.

20. A process according to claim 19, wherein the step of depressurizing said cooled second liquid phase comprises depressurizing said cooled second liquid phase to a temperature lower than a temperature range of from about 15° C. to 45° C.

21. A fluid cooling process for liquifying natural gas containing nitrogen, the process comprising steps of:

compressing a cooling mixture comprising constituents of various volatilities, in a penultimate stage among a plurality of compression stages;

partially condensing said mixture for obtaining a liquid fraction and a vapour fraction;

distilling at least said vapour fraction of the penultimate compression stage in a distillation apparatus comprising an upper head part and a lower part, while cooling said upper head part with a fluid having a temperature lower than a temperature range of from about 15° C. to 45° C., for obtaining a first head vapour phase and a first liquid phase;

sending said first head vapour phase toward the final compression stage of said plurality of compression stages, for obtaining a high pressure vapour phase; and cooling, depressurizing and putting into a heat exchange relation with said natural gas, at least some of said liquid fraction, said first liquid phase, said first head vapour phase and said high pressure vapour phase, thereby obtaining a liquified natural gas.

22. A process according to claim 21, wherein said fluid for cooling the head upper part of the distillation apparatus is a liquid.

23. A process according to claim 22, wherein the temperature of said liquid is in a temperature range of from about 0° C. to 20° C.

24. A process according to claim 22, further comprising:

subjecting said liquified natural gas to a de-nitrogenization process; and supercooling said liquified de-nitrogenized natural gas by heat exchange with liquified non-de-nitrogenized depressurized natural gas.

25. A process according to claim 22, further comprising:

performing a preliminary de-nitrogenization process on said liquified natural gas at a first pressure in an auxiliary preliminary de-nitrogenization column having an upper part and a lower part, for obtaining a vapour phase and a liquified preliminary de-nitrogenized natural gas;

depressurizing a first part of said liquified preliminary de-nitrogenized natural gas to an intermediate pressure lower than said first pressure, for obtaining a liquified depressurized preliminary de-nitrogenized natural gas;

vaporizing said liquified depressurized preliminary de-nitrogenized natural gas, while cooling the upper part of said preliminary de-nitrogenization auxiliary column, for producing a combustible gas at said intermediate pressure;

delivering said combustible gas to a gas turbine driven by a compressor; and providing a second part of said liquified preliminary de-nitrogenized natural gas to a final de-nitrogenization column, as well as said vapour phase of said preliminary de-nitrogenization auxiliary column, for treating therein said gas and said vapour phase at a pressure lower than said intermediate pressure, so as to produce a de-nitrogenized liquid natural gas adapted to be stored.

26. A process according to claim 21, further comprising partially condensing said first head vapour phase before compressing said first head vapour phase in said final compression stage.

27. A cooling installation for cooling a fluid, the installation comprising:

an integral incorporated cascade cooling circuit in which a coolant mixture circulates, said circuit including:

a compressor unit comprising a plurality of compression stages disposed in series and including intermediate stages of compression and a final stage of compression for compressing at least a part of said coolant mixture, at least said intermediate stages of compression comprising coolers;

a distillation apparatus interposed between a penultimate stage of compression and the final stage of compression, said distillation apparatus having an upper part and a lower part, said upper part being in fluid communication with an inlet of said final compression stage;

cooling means in fluid communication with said upper part of the distillation apparatus and in which circulates a liquid, for cooling said liquid to a cooling temperature adapted for cooling the upper part of said distilling apparatus; and a heat exchange line having an outlet in fluid communication with an inlet of the first of said plurality of compression stages, and inlets respectively in fluid communication with an admission conduit for said fluid to be cooled and with an outlet of at least some of said final compression stage, said distillation apparatus, and said coolers, for circulating and exchanging heat exchanging between the fluid to be cooled and at least a part of said coolant mixture.

28. An installation according to claim 27, wherein said cooling means are adapted for cooling said cooling liquid to a temperature lower than a temperature range of from about 15° C. to 45° C.

29. An installation according to claim 28, wherein said cooling temperature is in a temperature range of from about 0° C. to 20° C.

30. An installation according to claim 27, wherein said cooling means are disposed exteriorly to said distillation apparatus.

31. An installation according to claim 27, wherein said cooling means for cooling the upper part of said distillation apparatus comprise cooling ducts passing through said heat exchanger line, and a separation container for separating a vapour fraction from a liquid fraction, said separation container having a lower part and an upper part, said lower part of said separation container being in fluid communication with the upper part of said distillation apparatus and said upper part of said separation container being connected to the inlet of said final compression stage.

32. An installation according to claim 27, wherein said heat exchange line comprises at least one plate exchanger.

33. An installation according to claim 27, wherein said heat exchange line comprises a first plate heat exchanger constituting a hot portion of said heat exchange line, and a second plate heat exchanger constituting a cold portion of said heat exchange line, said first and second plate heat exchangers being disposed in series, and said inlets of the exchange line being disposed on said first plate heat exchanger.

34. An installation according to claim 33, wherein said first and second heat exchangers include ends which are butt-jointed so that at least a part of said cooling mixture passes directly from said second to said first heat exchanger.

35. An installation according to claim 27, wherein said cooling means are partially interposed between said upper part of the distillation apparatus and the final stage of compression.

36. An installation according to claim 27, wherein said cooling means comprise:

fluid condensing and separating means interposed between the outlet of said final compression stage and said heat exchange line for cooling the resultant of said final compression stage to substantially said cooling temperature and for obtaining a liquid fraction and a vapour fraction; and a depressurization valve interposed between said fluid condensing and separating means and said upper part of the distillation apparatus for depressurizing said liquid fraction obtained by the fluid condensing and separating means before providing the liquid fraction to said upper part of the distillation apparatus.

37. An installation according to claim 36, wherein said fluid condensing and separating means comprise a dephlegmator.

38. An installation according to claim 36, further comprising an auxiliary heat exchanger interposed between both said distilling apparatus and said final compression stage and between said fluid condensing and separating means and said depressurization valve, for receiving said liquid fraction of said fluid condensing and separating means and conducting a heat exchange relation between said liquid fraction and a head vapour issued from said cooled upper part of the distillation apparatus.

39. An installation according to claim 38, wherein said cooling means are adapted for cooling the cooling liquid to a temperature lower than a temperature range of from about 15° C. to 45° C.

40. An installation according to claim 38, wherein said cooling temperature is in a temperature range of from about 0° C. to 20° C.

41. An installation according to claim 27, further comprising:

a separator container interposed between the coolers of first and second compression stages of said intermediate compression stages, said separator container having an upper part and a lower part; and a pump having a suction inlet connected to said lower part of the separator container and a delivery outlet connected to the outlet of said second compression stage.

42. An installation according to claim 41, wherein said cooling means are adapted for cooling said cooling liquid to a temperature lower than a temperature range of from about 15° C. to 45° C.

43. A cooling installation for liquifying natural gas containing nitrogen, the installation comprising:

an integral incorporated cascade cooling circuit in which a coolant mixture circulates, said circuit comprising:

a compressor unit comprising several stages of compression disposed in series and including intermediate stages of compression and a final stage of compression for compressing at least a part of said coolant mixture, at least said intermediate stages of compression comprising coolers;

a distillation apparatus interposed between a penultimate stage of compression and a final stage of compression, said distillation apparatus having an upper part and a lower part, said upper part being in fluid communication with an inlet of said final compression stage;

cooling means in fluid communication with said upper part of the distillation apparatus in which circulates a liquid for cooling said liquid to a cooling temperature adapted for cooling the upper part of said distillation apparatus;

a heat exchange line having an outlet in fluid communication with the inlet of the first of said plurality of stages of compression, and inlets respectively in fluid communication with an admission conduit of said natural gas and with outlets of at least some of said final compression stage, said distillation apparatus and said coolers, the heat exchange line adapted to circulate the natural gas and at least a part of said coolant mixture to effect a heat exchange therebetween so as to liquify said natural gas;

a de-nitrogenization column receiving said liquified natural gas for performing at least a partial de-nitrogenization thereof; and a supercooling exchanger adapted for supercooling said at least partially de-nitrogenized liquified natural gas by a heat exchange with a non-de-nitrogenized depressurized natural gas.

44. A cooling installation for liquifying natural gas containing nitrogen, the installation comprising:

an integral incorporated cascade cooling circuit in which a coolant mixture circulates, said circuit comprising:

a compressor unit comprising a plurality of stages of compression disposed in series and including intermediate stages of compression and a final stage of compression for compressing at least a part of said coolant mixture, at least said intermediate stages of compression comprising coolers;

a distillation apparatus interposed between a penultimate stage of compression and the final stage of compression, said distillation apparatus having an upper part and a lower part, said upper part being in fluid communication with an inlet of said final compression stage;

cooling means in fluid communication with said upper part of the distillation apparatus for cooling a liquid which circulates therein to a cooling temperature adapted to cool the upper part of said distillation apparatus;

a heat exchange line having an outlet in fluid communication with the inlet of the first of said plurality of stages of compression, and inlets respectively in fluid communication with an admission conduit of said natural gas and with outlets of at least some of said final compression stage, said distillation apparatus and said coolers, for circulating in a heat exchange therebetween the natural gas and at least a portion of said coolant mixture so as to liquify said natural gas;

a primary de-nitrogenization column receiving said liquified natural gas for performing at least a partial de-nitrogenization thereof, said primary column having a lower part and an upper part and comprising inlets for said liquified natural gas which is provided at a determined pressure, and a head condenser disposed at the upper part of said primary column;

a depressurizing valve interposed between said lower part of said primary column and said head condenser for providing said head condenser with a liquid fraction of the gas in said column which has been depressurized in said valve to an intermediate pressure lower than said determined pressure;

a gas turbine connected to an outlet of said head condenser for being fed therefrom by a gas resulting from the vaporization in said head condenser of said depressurized liquid fraction; and a final low pressure de-nitrogenization column connected to said upper part and to said lower part of said primary de-nitrogenization column, for performing a final de-nitrogenization of said liquified natural gas so as to produce in a lower part of said final de-nitrogenization column a de-nitrogenized liquified natural gas adapted to be stored.

* * * * *